United States Patent [19]

Coates

[11] 4,032,004

[45] June 28, 1977

[54] TICKET DISPENSING ARRANGEMENT

[76] Inventor: Francis William Coates, Kings Highway Towers, Apartment A705, Maple-Shade, N.J. 08052

[22] Filed: July 9, 1975

[21] Appl. No.: 594,246

[52] U.S. Cl. ..... 206/39.6; 312/39

[51] Int. Cl.[2] ..... A45C 11/18

[58] Field of Search ..... 312/38, 39, 61, 71; 221/63, 70, 152; 206/39.1–39.9, 398, 409

[56] References Cited

UNITED STATES PATENTS

| | | | |
|---|---|---|---|
| 476,005 | 5/1892 | Davis | 206/39.8 |
| 1,339,823 | 5/1920 | Harbaugh | 312/39 |
| 2,056,279 | 10/1936 | Kulick | 206/39.6 |
| 2,847,118 | 8/1958 | Johnson | 312/39 |

*Primary Examiner*—Casmir A. Nunberg
*Attorney, Agent, or Firm*—Craig & Antonelli

[57] ABSTRACT

A ticket dispensing container for housing a number of folded tickets which container includes a first locking arrangement for preventing re-insertion of a ticket which has been withdrawn at least half way out of the container and a second locking arrangement for preventing re-insertion of a completely withdrawn ticket. Retaining elements are provided in the container for holding the tickets in a uniform upright position and access is provided in the container to air in advancing a ticket to a tear-off position. The container includes a wall element for limiting the forward advancement of a single ticket. A mounting plate is provided to facilitate the mounting of the ticket dispensing container on a counter or the like.

45 Claims, 8 Drawing Figures

TICKET DISPENSING ARRANGEMENT

The present invention relates to a dispensing arrangement and a method for operating the same, more particularly, to a dispensing container for dispensing lottery tickets or coupons and a method of operating a lottery utilizing the dispensing container.

While the running of lotteries has become increasingly popular, certain problems such as left over winning tickets, unsold winning tickets, and lack of information of winning numbers, etc have not generated sufficient interest of the lotteries in the buying public.

The aim underlying the present invention essentially resides in avoiding the problems encountered in running lotteries by providing a lottery ticket or coupon dispensing device which makes the sale of tickets easier, guarantees absolute fairness, and provides instant winners thereby generating interest in the buying public.

Ticket dispensing arrangements are known, for example, U.S. Pat. No. 1,339,823, wherein a ribbon of consecutive tickets are disposed in a container with means being provided for preventing re-insertion of a withdrawn ticket. However, such dispensing arrangements are not suitable for dispensing lottery tickets or coupons since access to the ticket container is readily obtainable and subsequent tickets may be partially withdrawn thereby exposing the lottery number of such subsequent tickets.

The present invention seeks to avoid the disadvantages and difficulties encountered in the prior art ticket dispensing devices of the aforementioned type by providing a ticket dispensing container. in which lottery tickets or coupons are sealed therein after loading thereby preventing access and tampering with the tickets.

According to one feature of the present invention, locking means are provided for preventing re-insertion of a ticket or coupon once such ticket has either been withdrawn partially or completely from the ticket container.

According to a further feature of the present invention, means are provided in the ticket container for retaining the coupons or tickets in a uniform upright position thereby facilitating the withdrawal of the same from the container.

According to yet another feature of the present invention, means are provided for limiting the forward advancement of a single ticket or coupon.

Accordingly, it is an object of the present invention to provide an improved ticket dispensing arrangement which, once loaded, is totally sealed thereby preventing access to the tickets.

A further object of the present invention resides in providing a ticket dispensing arrangement which may be easily assembled and inexpensively manufactured.

Still another object of the present invention resides in providing a ticket dispensing arrangement which facilitates the dispensing of lottery tickets or coupons.

A further object of the present invention resides in providing a method of running a lottery whereby it is possible to have instant winners up to a set number of digits covering a number of small prizes and leaving a large prize or prizes to be drawn after all the tickets have been sold thereby keeping every ticket alive until the final drawing so that each ticket could be a potential winner of a big prize without the elimination process presently employed.

Still another object of the present invention resides in providing a method of running a lottery whereby operating expenses of the lottery may be reduced as much as fifty percent.

These and other objects, features and advantages of the present invention will become more obvious from the following description when taken in connection with the accompanying drawing which shows for the purpose of illustration only, several embodiments in accordance with the present invention, and wherein.

Figure 1:
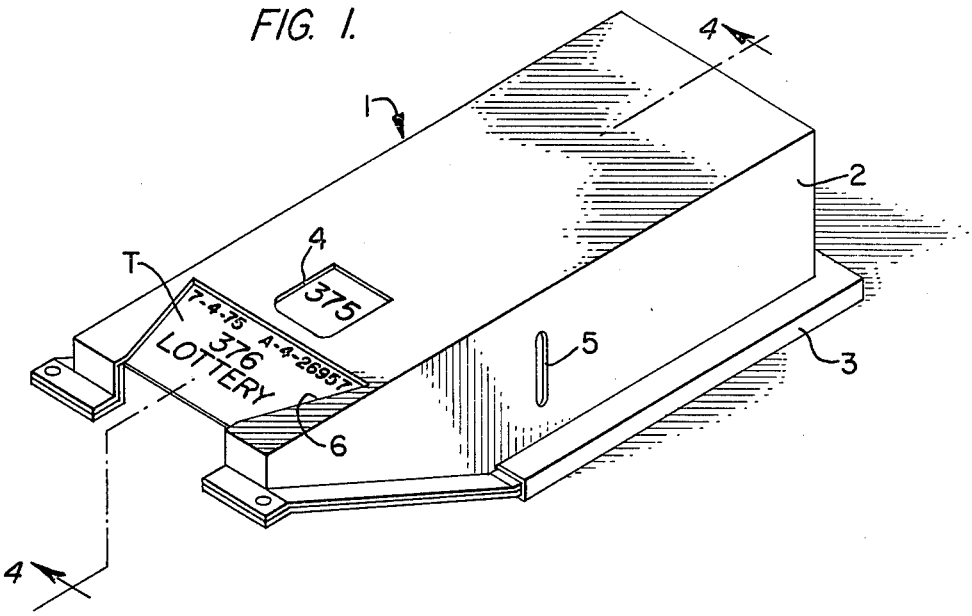
FIG. 1 is a perspective view of an assembled ticket dispensing arrangement in accordance with the present invention.

Referring now to the drawings wherein like reference numerals are used throughout the various views to designate like parts and, more particularly, to FIG. 1, wherein a ticket dispensing container generally designated by the reference numeral 1 is provided and includes a cover member 2 mounted on a base member 3. The cover member 2 is provided with a window or aperture 4 for facilitating the grasping and advancement of a coupon or ticket T to the tear-off position at the window 6. Additionally, as shown in FIG. 1, the window or aperture 4 permits a viewing of the serial number of the ticket or coupon T whereby the number of tickets remaining in the dispenser can readily be ascertained. However, by virtue of the location of the lottery ticket number on the coupon or ticket T such number remains concealed until the ticket is extracted as shown in FIG. 1.

A slot 5 is provided in the cover member 2 for receiving a retaining or positioning rod 12 which is described more fully hereinafter.

Figure 2:
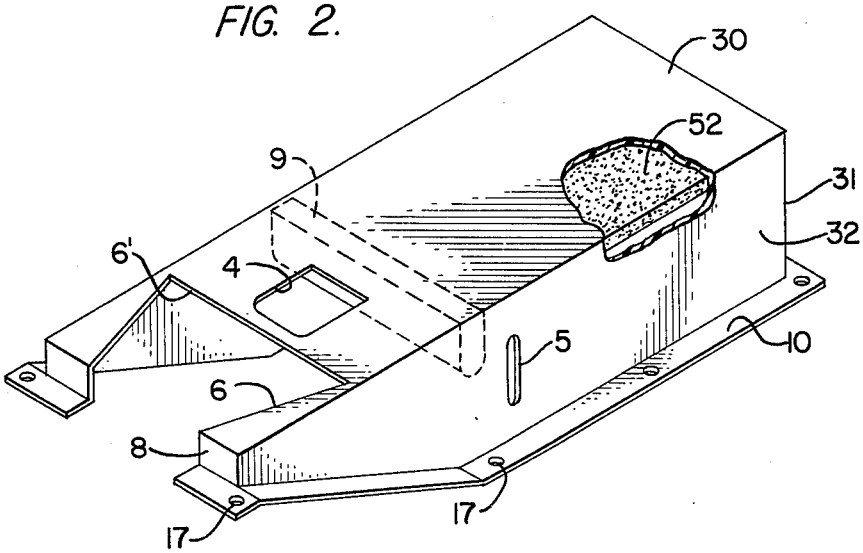
FIG. 2 is a perspective view of a cover portion of the ticket dispensing arrangement of FIG. 1.

As shown in FIG. 2, an upper wall 30 of the cover member 2 is provided with a layer of material 52. This material may consist of a foam rubber or sponge-like material and may be either secured by fasteners (not shown) or by a suitable adhesive to the wall 30. A flange 10 is provided at the lower end of the cover member 2 and overlies the peripheral edge of the base member 3 in the assembled condition of the container 1. A plurality of apertures or holes 17 are provided in the flange 10 for receiving suitable alignment lugs (FIG. 3) provided on the base member 3.

A locking tab 9 is provided on the upper wall 30 forwardly of the layer of material 52 and serves to prevent a withdrawn ticket T from being re-inserted into the ticket container 1 once the ticket has been fully extended and also serves to ease the flow of the tickets from the container 1.

The cover member 2 includes a vertically extending wall portion 8 at the forward end of the ticket container 1 which serves to limit the forward advance of a single ticket; however, it is understood that by grasping the advanced ticket any desired number of tickets may be dispensed prior to separating the tickets T from the dispenser. The window 6 is provided with a straight edge portion 6′ to ensure the uniform separation of the tickets or coupons at perforations P (FIG. 4) normally provided thereon. It is understood that the tickets or coupons need not be provided with perforation and the edge 6 may be provided with suitable serrations (not shown) of the like to facilitate the separation of the individual tickets T.

Figure 3:
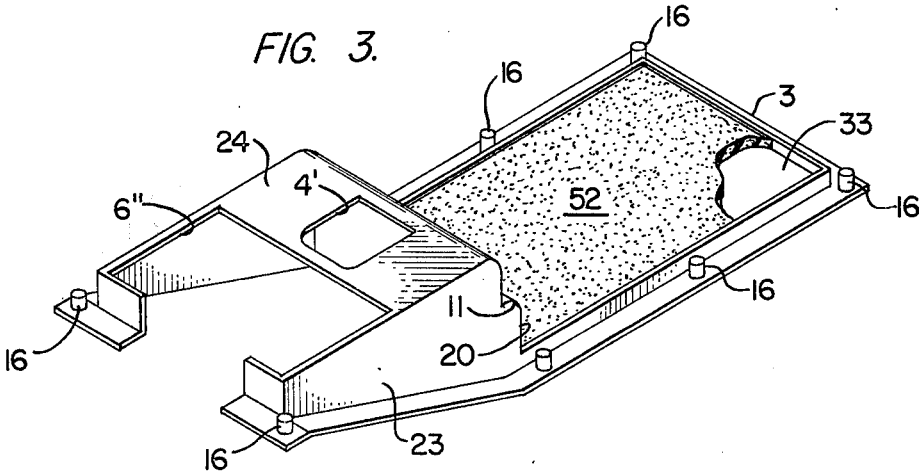
FIG. 3 is a perspective view of a base portion of the ticket dispensing arrangement of FIG. 1.

As shown in FIG. 3, the base member 3 is also provided with a layer of foam rubber or sponge-like material 52 on the bottom wall 33. The layer of material may be secured to the bottom wall 33 by conventional fasteners (not shown) or by a suitable adhesive. Alignment lugs 16 are disposed about the peripheral edge of the bottom wall 33 and are received in apertures or holes 17 in the flange 10 of the cover means 32. Windows or apertures 4′, 6″ are provided in an upper wall 24 of the base member 3 and are in alignment with the windows 4, 6 of the cover member 2 when the container 1 is assembled.

The base member 3 is provided with a locking tab 11 integrally formed or attached by conventional means (not shown) to a vertical wall portion 20. The locking tab 11 ensures the retention of tickets T in an accessible position and also eases the flow of the tickets T into a dispensing slot S formed between the upper wall 24 of the base member 3 and an extension 30′ of the wall 30 of cover member 2 when the container 1 is assembled.

Figure 4:
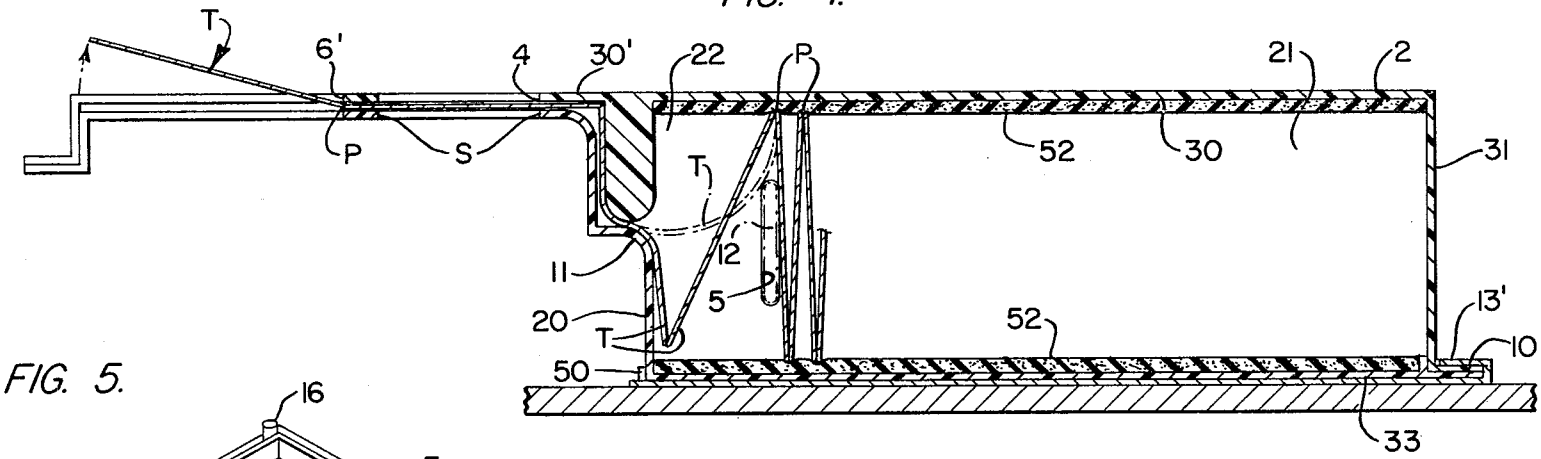
FIG. 4 is a cross-sectional view taken along line IV—IV of FIG. 1.

As shown in FIG. 4, in the assembled condition the ticket container 1 essentially defines two chambers 21, 22 with the first chamber 21 housing a folded ticket package and with the layers of material 52 on the upper wall 30 and bottom wall 31 retaining the tickets T in a uniform upright position. A retaining rod 12 is disposed forwardly of the chamber 21 to expedite the loading operation of the tickets T. After assembly, the retaining rod 12 is removed through the slot 5 (FIGS. 1, 2) provided in the cover member 2.

Preferably, the distance between the straight edge portion 6′ of the window 6 and locking tab 9 is at least equal to the length of the ticket T as evident from FIG. 4 thereby ensuring a preventing of re-insertion of the ticket T into the container 1 once the ticket is withdrawn from the chamber 22. Also, preferably, the locking tab 11 is provided on the wall 20 at a distance at least equal to one half of the length of the ticket T.

Once at least half of the ticket T is withdrawn through the slot S the ticket T is displaced from the solid line position shown in FIG. 4 to the phantom line position with the rear edge of the ticket T being brought into engagement with the upper surface of the locking tab 11.

The window 4 is arranged in the cover member 2 so that even as the ticket is advanced, the ticket number is concealed until the ticket is completely withdrawn from the slot S.

Preferably, according to the present invention, the cover member 2 and the base member 3 are fabricated from an injection molded plastic or other similar material and, after the cover member 2 and base member 3 are assembled, the entire container is sealed, for example, by heat fusion.

To facilitate loading of the ticket container 1 preferably, the first two and last two tickets of a ticket package inserted into the container are blank. A folded ticket package is disposed in the chamber 21 in the upright position between the retaining rod 12 and back wall 31 of the cover member 2. The first two blank tickets of the ticket package are then placed in the slot S with the rear edge of one of the tickets resting on the locking tab 11 and the front edge being located in the window 4. The entire unit is then sealed and the retaining rod 12 is withdrawn through the slot 5 provided in one of the side walls 32 of the cover member 2. As is readily apparent, upon withdrawal of the first two blank tickets, the first numbered ticket will then be brought into registry with the window 4.

Figure 5:
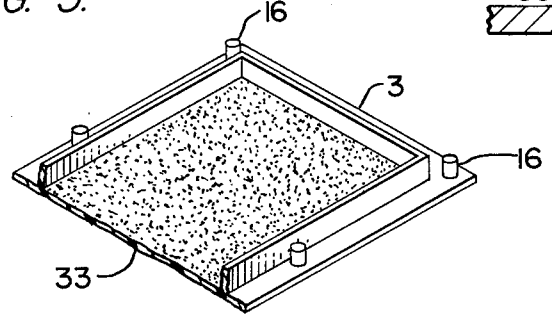
FIG. 5 is a partial cross-section view of a base portion of an alternate embodiment of the present invention.

FIG. 5 illustrates an alternate embodiment of a base portion of the present invention wherein the bottom wall 33 is provided with a roughened or textured surface to retain the ticket T in a uniform upright position when the ticket package is disposed in the ticket dispenser.

Figure 6:
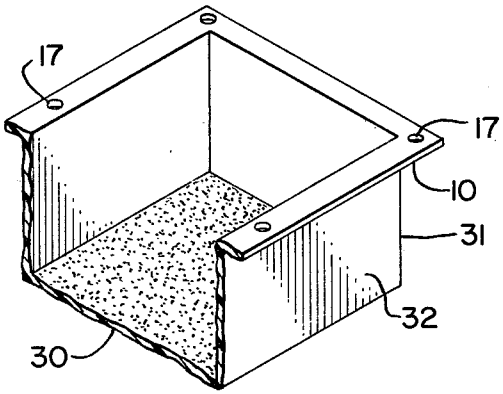
FIG. 6 is a partial cross-sectional view of a cover portion which may be utilized with the base portion of FIG. 5.

FIG. 6, illustrates an alternate embodiment of a cover portion which may be utilized with the base portion of FIG. 5, wherein the upper wall 30 is provided with a roughened or textured surface portion for retaining the housed tickets in an upright position after removal of the retaining rod 12.

Figure 7:
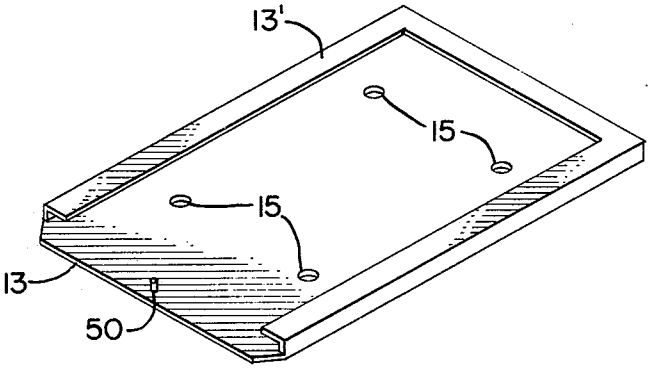
FIG. 7 is a mounting bracket for a ticket dispensing arrangement in accordance with the present invention.

As shown in FIG. 7, a mounting bracket 13 may be provided for securing the ticket container 1 to a counter surface or the like. The bracket 13 is provided with a plurality of spaced holes or apertures 15 for receiving suitable conventional fasteners (not shown) to secure the bracket to the counter surface. The bracket 13 is provided with an upstanding substantially U-shaped flange 13′ about the peripheral edge thereof which serves to receive the edge of the base member 3 and flange 10 of the cover member 2 when the ticket container 1 is assembled. A resilient member such as a spring finger 50 is provided to fixedly secure the ticket container 1 in the mounting bracket 13.

Figure 8:
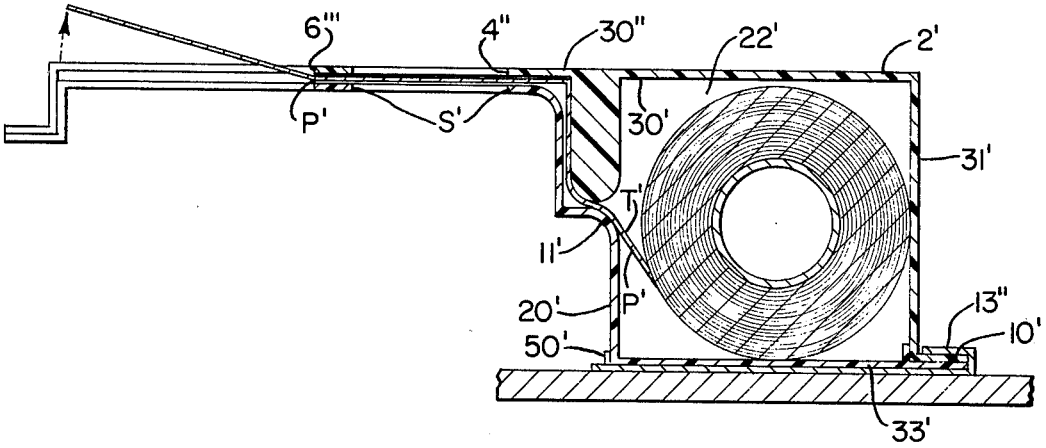
FIG. 8 is a cross-sectional view of a further embodiment of a ticket dispenser in accordance with the present invention.

FIG. 8 illustrates a further embodiment of the present invention wherein a cover member 2′ is provided having an upper wall portion 30″ having an extension 30‴ in which is formed a window 4″ for permitting the viewing of the serial number of the ticket or coupon T and facilitating the grasping and advancement of the ticket. An edge 6‴ is provided to ensure uniform separation of the ticket T. The cover member 2′ also includes a back wall 31′ and a flange portion 10′ receivable in U-shaped flanges 13″ of the mounting bracket.

The base member 3 includes a bottom wall 33′ and vertical wall portion 20′ upon which is provided a locking tab 11′ which cooperates with the downwardly projecting locking tab on the cover member 2′ to control the dispensing of the tickets in the manner described hereinabove.

As apparent from FIG. 8, in the assembled condition the cover member 2′ and base member 3 define a chamber 22′ in which is mounted a roll of tickets T′ which are advanced from the chamber 22′ through the slot S′ to the dispensed position. If desired suitable mounting brackets (not shown) may be provided on the side walls of the cover member 2′ to mount the roll of tickets T′ in the chamber 22′.

Preferably, the cover member 2′ and the base member 3′ are fabricated from injection molded plastic or other similar material and, after assembly, the entire container is sealed, for example, by heat fusion.

To facilitate alignment of the cover member 2' and base member 3' alignment lugs (not shown), for example lugs 16 (FIG. 3) are provided and a resilient spring finger 50' or the like is provided to fixedly secure the assembly to the mounting bracket.

The roll of tickets T' may be provided with suitable perforation P'. However, it is understood that no perforations may be necessary and suitable serrations (not shown) or the like may be provided at the edge 6'''.

To facilitate loading of the container of FIG. 8, as with the other described embodiments the first two and, if desired, the last two tickets T' on the roll are blank. The roll of tickets T' is mounted in the chamber 22' and the first two blank tickets are then placed in the slot S' with the rear edge of one of the tickets T' resting on the locking tab 11' and the front edge of the ticket being located in the window 4''. The entire unit is then sealed and the sealed tickets are read for dispensing.

According to the present invention, in utilizing the above-described ticket dispenser, it would be possible to print, for example, several million lottery tickets and seal, for example, 500 of such tickets in each of the ticket containers 1. Instead of having each of the tickets identified by a number such as 2 3 4 5 6 7, each million tickets could be identified by a letter of the alphabet in addition to a number, for example, A-234567 through Z-999999, if necessary. It is understood that the various lottery numbers are randomly generated and printed on the tickets whereby the lottery ticket numbers in a dispenser would not contain sequential numbers.

Prior to conducting the lottery, a first winning number or series of numbers would be selected or drawn, which number or numbers would correspond to the last five digits of the ticket number, for example B-80573. The winning number or numbers would then be displayed along with the ticket container 1 whereby, upon withdrawal of a ticket from the container 1, a winning ticket would readily easily be identified.

After all the tickets have been sold, a selection or drawing of a number and letter of the alphabet could be effected to determine the grand prize winner.

The mechanism of this dispenser is unique inasmuch that there are no moving parts required except the ticket itself. This is accomplished by utilizing the perforated part of the ticket as a locking device by combining a lower curved member and a top right angled member, separated by a channel that allows the easy flow of the tickets in an outward movement but prevents the re-insertion when the perforated portion on being pushed backwards forms a L-shape and locks itself against the right angled member thus making it impossible to extract a ticket and check the number and then re-insert same.

The base member of the dispenser and the top member are lined on the inside walls that confront each other that is from top to bottom with a sponge like surface, or a rough surface that can be incorporated into the mold at the time of manufacture, for the purpose of holding the tickets firmly in an upright position during the length of time that they are sealed in the dispenser.

Therefore, the main features of my invention are: no moving parts except the ticket itself, utilizing a curved lower member for easy extraction; a top and bottom right angled member for prevention of re-insertion of a withdrawn ticket; a dispenser than can be completely sealed into one unit; a product that is very economical to manufacture; and a dispenser that facilitates the handling of said tickets.

While I have shown and described several embodiments in accordance with the present invention, it is understood that the same is not limited thereto but is susceptible of numerous changes and modifications as known to a person skilled in the art, and I therefore do not wish to be limited to the details shown and described herein but intend to cover all such changes and modifications as are encompassed by the scope of the appended claims.

I claim:

1. A dispensing apparatus for dispensing tickets, the apparatus comprising: a base member; a cover member disposed on said base member including a top wall spaced from said base member, a pair of spaced vertical side walls extending from said top wall to said base member, and a rear wall, said top wall, said side walls and said rear wall of said cover member forming the outer walls of the dispensing apparatus and defining therebetween a chamber for housing a plurality of tickets; a dispensing slot provided at one end of said chamber for dispensing tickets therefrom; a first locking means arranged on the top wall of the cover member for retaining a ticket in said dispensing slot; and a second locking means provided on said base member for preventing re-insertion of a withdrawn ticket into said chamber.

2. An apparatus according to claim 1, wherein means are provided in said top wall of said cover member for facilitating advancement of a ticket from said chamber through said dispensing slot.

3. An apparatus according to claim 2, wherein said means for facilitating the advancement of a ticket includes a window provided in said top wall.

4. An apparatus according to claim 3, wherein said first locking means is a locking tab projecting downwardly from said top wall into said chamber, said locking tab being disposed at a point on said top wall where the dispensing slot enters said chamber.

5. A dispensing apparatus for dispensing tickets, the apparatus comprising: a base member; a cover member disposed on said base member including an upper wall portion spaced from said base member, a pair of spaced vertical side wall portions extending from said upper wall portion to said base member, and a rear wall portion, said wall portions of said cover member defining a chamber for housing a plurality of tickets; a dispensing slot provided in said chamber for dispensing tickets therefrom; a first locking means provided on said upper wall portion of said cover member for retaining a ticket in said dispensing slot, said first locking means including a locking tab projecting downwardly from said upper wall portion into said chamber, said locking tab being disposed at a point on said upper wall portion where the dispensing slot enters said chamber; a second locking means provided on said base member for preventing re-inserting of a withdrawn ticket into said chamber; and means provided in said upper wall portion of said cover member for facilitating advancement of a ticket from said chamber through said dispensing slot including a window provided in said upper wall portion; said base member includes a vertically extending wall portion disposed parallel to said rear wall portion of said cover member and spaced therefrom, said wall portion of said base member being spaced from said locking tab in the direction of said dispensing slot to define a passage communicating with said chamber and said dispensing slot, said passage guiding a ticket from said chamber to said dispensing slot.

6. An apparatus according to claim 5, wherein said second locking means includes a further locking tab disposed on said vertically extending wall portion of said base member and extending horizontally therefrom.

7. An apparatus according to claim 6, wherein said further locking tab disposed on said wall portion of said base member is spaced from said dispensing slot by a distance equal to at least one half the length of a ticket.

8. An apparatus according to claim 7, wherein retaining means are provided for retaining the plurality of tickets in a predetermined position in said chamber.

9. An apparatus according to claim 8, wherein said retaining means at least includes a roughened surface portion provided on one of said upper wall portion and said base member for retaining the plurality of tickets in a predetermined position in said chamber.

10. An apparatus according to claim 8, wherein said retaining means includes a roughened surface portion provided on both said upper wall portion and said base member for retaining said plurality of tickets in a predetermined position in said chamber.

11. An apparatus according to claim 8, wherein said retaining means includes a layer of textured material provided on at least one of said upper wall portion of said cover member and said base member.

12. An apparatus according to claim 11, wherein said layer of textured material is provided on both said upper wall portion of said cover member and on said base member.

13. An apparatus according to claim 12, wherein said layer of material consists of a foam rubber.

14. An apparatus according to claim 8, wherein means are provided on said cover member and on said base member for facilitating the alignment of said cover member and said base member.

15. An apparatus according to claim 8, wherein said retaining means further includes a removable retaining rod.

16. An apparatus according to claim 15, wherein said cover member further includes a horizontally extending flange portion provided along the periphery thereof, said flange portion being provided with a plurality of spaced apertures, said base member further includes a plurality of alignment lugs for facilitating alignment of said cover member and said base member.

17. An apparatus according to claim 16, further comprising a mounting bracket for mounting the dispensing apparatus, said mounting bracket being provided with an upstanding flange portion for receiving the peripheral edge of said base member and said horizontal flange portion of said cover member, and wherein resilient means are provided for securing the dispensing apparatus to said mounting bracket.

18. An apparatus according to claim 17, wherein said plurality of tickets are folded accordion style in said chamber.

19. An apparatus according to claim 17, wherein said plurality of tickets are disposed on a roll mounted in said chamber.

20. An apparatus according to claim 7, wherein a second window is provided in said upper wall portion of said cover member, said second window including an edge portion for facilitating the separation of adjacent tickets.

21. An apparatus according to claim 20, wherein said edge portion is spaced from said first locking means by a distance equal to at least the length of a ticket.

22. A dispensing apparatus for dispensing tickets, the apparatus comprising: a base member; a cover member disposed on said base member including an upper wall portion spaced from said base member, a pair of spaced vertical wall portions extending from said upper wall portion to said base member, and a rear wall portion, said wall portions of said cover member defining a chamber for housing a plurality of tickets; a dispensing slot provided in said chamber for dispensing tickets therefrom; a first locking means for retaining a ticket in said dispensing slot; a second locking means for preventing re-insertion of a withdrawn ticket into said chamber; means provided in said upper wall portion of said cover member for facilitating advancement of a ticket from said chamber through said dispensing slot; and means for limiting the forward advance of a ticket from said chamber.

23. An apparatus according to claim 22, wherein said limiting means includes a vertically extending wall portion provided on said cover member.

24. An apparatus according to claim 1, wherein retaining means are provided in said chamber for retaining the plurality of tickets in a predetermined position.

25. An apparatus according to claim 24, wherein means are provided on said cover member and on said base member for facilitating the alignment of said cover member and said base member.

26. An apparatus according to claim 24, wherein said retaining means includes a layer of textured material provided on at least one of said top wall of said cover member and said base member.

27. An apparatus according to claim 24, wherein said layer of textured material is provided on both said top wall of said cover member and on said base member.

28. An apparatus according to claim 27, wherein said layer of material consists of foam rubber.

29. A dispensing apparatus for dispensing tickets, the apparatus comprising: a base member; a cover member disposed on said base member including an upper wall portion spaced from said base member, a pair of spaced vertical side wall portions extending from said upper wall portion to said base member, and a rear wall portion, said wall portions of said cover member defining a chamber for housing a plurality of tickets; a dispensing slot provided in said chamber for dispensing tickets therefrom; a first locking means for retaining a ticket in said dispensing slot; and a second locking means for preventing re-insertion of a withdrawn ticket into said chamber; and wherein at least one of said upper wall portion and said base member is provided with a roughened surface portion for retaining the plurality of tickets in a predetermined position in said chamber.

30. A dispensing apparatus for dispensing tickets, the apparatus comprising: a base member; a cover member disposed on said base member including an upper wall portion spaced from said base member, a pair of spaced vertical side wall portions extending from said upper wall portion to said base member, and a rear wall portion, said wall portions of said cover member defining a chamber for housing a plurality of tickets; a dispensing slot provided in said chamber for dispensing tickets therefrom; a first locking means for retaining a ticket in said dispensing slot; and a second locking means for preventing re-insertion of a withdrawn ticket into said chamber; and wherein both said upper wall portion and said base member are provided with a roughened surface portion for retaining said plurality of tickets in a predetermined position in said chamber.

31. A method of operating a lottery comprising the steps of:

providing tickets having printed thereon alphabetic and numerical identifying indicia reflecting the individual number of a respective ticket;

disposing a plurality of said tickets in a sealed container with the identifying indicia being concealed until after complete withdrawal of a respective ticket from said sealed container;

selecting at least one individual winning number which is composed of only some of the identifying indicia of a respective ticket;

displaying said at least one winning number with said sealed containers;

dispensing said tickets from said sealed container; and selecting a further winning number after dispensing all of the tickets from the sealed container which further winning number is composed of the remaining identifying indicia on the respective tickets.

32. An apparatus according to claim 22, wherein retaining means are provided for retaining the plurality of tickets in a predetermined position in said chamber.

33. An apparatus according to claim 32, wherein said retaining means at least includes a roughened surface portion provided on one of said upper wall portion and said base member for retaining the plurality of tickets in a predetermined position in said chamber.

34. An apparatus according to claim 32, wherein said retaining means includes a roughened surface portion provided on both said upper wall portion and said base member for retaining said plurality of tickets in a predetermined position in said chamber.

35. An apparatus according to claim 32, wherein said retaining means includes a layer of textured material provided on at least one of said upper wall portion of said cover member and said base member.

36. An apparatus according to claim 32, wherein said layer of textured material is provided on both said upper wall portion of said cover member and on said base member.

37. An apparatus according to claim 32, wherein said layer of material consists of a foam rubber.

38. An apparatus according to claim 32, wherein said retaining means further includes a removable retaining rod.

39. An apparatus according to claim 22, wherein means are provided on said cover member and on said base member for facilitating the alignment of said cover member and said base member.

40. An apparatus according to claim 22, wherein said cover member further includes a horizontally extending flange portion provided along the periphery thereof, said flange portion being provided with a plurality of spaced apertures, said base member further includes a plurality of alignment lugs for facilitating alignment of said cover member and said base member.

41. An apparatus according to claim 40, further comprising a mounting bracket for mounting the dispensing apparatus, said mounting bracket being provided with an upstanding flange portion for receiving the peripheral edge of said base member and said horizontal flange portion of said cover member, and wherein resilient means are provided for securing the dispensing arrangement to said mounting bracket.

42. An apparatus according to claim 22, wherein said plurality of tickets are folded accordion-style in said chamber.

43. An apparatus according to claim 22, wherein said plurality of tickets are disposed on a roll mounted in said chamber.

44. An apparatus according to claim 22, wherein a window is provided in said upper wall portion of said cover member, said window including an edge portion for facilitating the separtion of adjacent tickets.

45. An apparatus according to claim 44, wherein said edge portion is spaced from said first locking means by a distance equal to at least the length of a ticket.

* * * * *